US008636630B2

(12) United States Patent
Morris

(10) Patent No.: US 8,636,630 B2
(45) Date of Patent: Jan. 28, 2014

(54) BALL NEST WITH VARIABLE RESISTANCE FOR FITNESS AND WELLNESS MOVEMENT

(76) Inventor: Nicholas Morris, Redondo Beach, CA (US)

( * ) Notice: Subject to any disclaimer, the term of this patent is extended or adjusted under 35 U.S.C. 154(b) by 208 days.

(21) Appl. No.: 13/109,654

(22) Filed: May 17, 2011

(65) Prior Publication Data

US 2011/0287907 A1 Nov. 24, 2011

Related U.S. Application Data

(60) Provisional application No. 61/395,823, filed on May 17, 2010.

(51) Int. Cl.
*A63B 21/00* (2006.01)

(52) U.S. Cl.
USPC ..... 482/117; 482/118; 482/71; 482/72

(58) Field of Classification Search
USPC ..... 482/117, 118, 71, 72, 74
See application file for complete search history.

(56) References Cited

U.S. PATENT DOCUMENTS

| | | | | |
|---|---|---|---|---|
| 1,535,391 | A * | 4/1925 | Anderson | 482/117 |
| 2,126,443 | A * | 8/1938 | Begley | 482/117 |
| 4,249,727 | A | 2/1981 | Dehan | |
| 7,115,078 | B1 * | 10/2006 | Kalember et al. | 482/117 |

* cited by examiner

*Primary Examiner* — Jerome W Donnelly
(74) *Attorney, Agent, or Firm* — Superior IP, PLLC; Dustin L. Call

(57) ABSTRACT

One example embodiment includes a ball nest for providing resistance in an exercise system. The ball nest includes a first portion, where an interior section of the first portion forms at least part of a zone of a sphere. The ball nest also includes a second portion. An interior section of the second portion forms at least part of the zone of the sphere and the second portion is configured to mate with the first portion. The mating of the first portion and the second portion is configured to enclose a ball. The ball nest further includes an adjustable attachment, where the adjustable attachment is configured to adjust the position of the first portion relative to the second portion.

19 Claims, 8 Drawing Sheets

BALL NEST WITH VARIABLE RESISTANCE FOR FITNESS AND WELLNESS MOVEMENT

CROSS-REFERENCE TO RELATED APPLICATIONS

This application claims the benefit of and priority to U.S. Provisional Patent Application Ser. No. 61/395,823 filed on May 17, 2010, which application is incorporated herein by reference in its entirety.

This application is related to U.S. application Ser. No. 13,109,652, filed on May 17, 2011, and entitled, "VARIABLE RESISTANCE FITNESS CHAMBER FOR ROTATIONAL TORQUE", which application is incorporated herein by reference in its entirety.

U.S. application Ser. No. 13,109,652, filed on May 17, 2011, and entitled, "VARIABLE RESISTANCE FITNESS CHAMBER FOR ROTATIONAL TORQUE" claims the benefit of and priority to U.S. Provisional Patent Application Ser. No. 61/395,784 filed on May 17, 20101, which application is incorporated herein by reference in its entirety.

This application is related to U.S. application Ser. No. 13,109,658, filed on May 17, 2011, and entitled, "VERTICAL MOVEMENT VIBRATING EXERCISE AND WELLNESS PLATFORM", which application is incorporated herein by reference in its entirety.

U.S. application Ser. No. 13,109,658, filed on May 17, 2011, and entitled, "VERTICAL MOVEMENT VIBRATING EXERCISE AND WELLNESS PLATFORM" claims the benefit of and priority to U.S. Provisional Patent Application Ser. No. 61/395,819 filed on May 17, 2010, which application is incorporated herein by reference in its entirety.

This application is related to U.S. application Ser. No. 13,109,662, filed on May 17, 2011, and entitled, "VARIABLE-RESISTANCE FUNCTIONAL FITNESS BAG", which application is incorporated herein by reference in its entirety.

U.S. application Ser. No. 13,109,662, filed on May 17, 2011, and entitled, "VARIABLE-RESISTANCE FUNCTIONAL FITNESS BAG" claims the benefit of and priority to U.S. Provisional Patent Application Ser. No. 61/395,822 filed on May 17, 2010, which application is incorporated herein by reference in its entirety.

This application is related to U.S. application Ser. No. 13,109,664, filed on May 17, 2011, and entitled, "VARIABLE RESISTANCE PULLEY FOR BODY-WEIGHT ROTATION EXERCISE", which application is incorporated herein by reference in its entirety.

U.S. application Ser. No. 13,109,664, filed on May 17, 2011, and entitled, "VARIABLE RESISTANCE PULLEY FOR BODY-WEIGHT ROTATION EXERCISE" claims the benefit of and priority to U.S. Provisional Patent Application Ser. No. 61/395,847 filed on May 17, 2010, which application is incorporated herein by reference in its entirety.

This application is related to co-pending U.S. application Ser. No. 13,109,666, filed on May 17, 2011, and entitled, "TRI-CIRCULAR EXERCISE DEVICE WITH VARIABLE ROTATION RESISTANCE", which application is incorporated herein by reference in its entirety.

U.S. application Ser. No. 13,109,666, filed on May 17, 2011, and entitled, "TRI-CIRCULAR EXERCISE DEVICE WITH VARIABLE ROTATION RESISTANCE" claims the benefit of and priority to U.S. Provisional Patent Application Ser. No. 61/395,817 filed on May 17, 2010, which application is incorporated herein by reference in its entirety.

BACKGROUND OF THE INVENTION

The benefits of exercise are numerous and well documented. For example, exercise can reduce the instance and severity of many diseases. In addition, exercise can make a person feel better about themselves and provide the user with increased self-confidence and feelings of self-worth. However, many would be exercisers are intimidated by complex fitness machines and uncomfortable and unnatural motions associated with exercising. In addition, they may be reluctant to use heavy weights which can cause injury to the user.

Fitness machines have been made in the past that eliminate the heavy weights by using resistance within materials, such as elastic materials. These can allow the user to vary resistance. However, this creates the side effect of creating "reactive-force". I.e., as the user performs the exercise movement, the resistance being used causes a reaction force into the user's body. The greater the resistance, the greater the reactive force.

Reactive force can cause damage to the user's body if the resistance is too strong for a user and the exercise movement becomes uncontrolled. Additionally, reactive force can also accumulate a "break-down" effect in the ligaments, tendons or other soft tissues in the exercising user, and their associated muscle groups. Further, reactive force is a dissipated energy, and means a less than optimal result to the exerciser, meaning a poor return on time and effort invested in the exercise.

Additionally, many exercise systems allow only a single resistance setting. I.e., the system allows for a single exercise at a single resistance. This does not allow the exercise system to be used by individuals of different fitness levels. In particular, some individuals will be too new to exercising to use the exercise system while other individuals will be too advanced. Only the small group in the middle will be able to use the system.

In addition, elastic materials can rebound if the material fails. I.e., as the elastic material is stretched, the force is stored in the material. When the material fails the force in the material can cause sudden and unpredictable movement, which has potential to injure the user or damage the equipment. This is an inherent danger of the materials and the ability to reduce or eliminate this danger is very limited.

Further, many exercise systems use unnatural movements. I.e., they involve movements that the user does not perform when not doing that particular exercise. These unnatural movements can cause injury to the user. Often, the user will not even be aware of the injury until it becomes a major injury because they do not perform that movement unless exercising.

Accordingly, there is a need in the art for an exercise system which uses resistance that is not produced by elastic materials. Additionally, there is a need in the art for the exercise system to allow the user to select from variable resistance. Further, there is a need in the art for the system to prevent reactive forces from entering the user's body. Moreover there is a need for the exercise system to allow the user to exercise using natural movements.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a ball nest for providing resistance in an exercise system. The ball nest includes a first portion, where an interior section of the first portion forms at least part of a zone of a sphere. The ball nest also includes a second portion. An interior section of the second portion forms at least part of the zone of the sphere and the second portion is configured to mate with the first portion. The mating of the first portion and the second portion is configured to enclose a ball. The ball nest further includes an adjustable attachment, where the adjustable attachment is configured to adjust the position of the first portion relative to the second portion.

Another example embodiment includes system for allowing a user to exercise. The system includes a ball nest. The ball nest includes a first portion, where an interior section of the first portion forms at least part of a zone of a sphere. The ball nest also includes a second portion. An interior section of the second portion forms at least part of the zone of the sphere and the second portion is configured to mate with the first portion. The ball nest further includes an adjustable attachment, where the adjustable attachment is configured to adjust the position of the first portion relative to the second portion. The system also includes a ball, where the mating of the first portion and the second portion is configured to enclose the ball. The ball is configured to rotate within the ball nest.

Another example embodiment includes system for allowing a user to exercise. The system includes a portable plate. The portable plate includes one or more feet, where the one or more feet are configured to support the portable plate against an external surface, and one or more slots. The system also includes a ball nest. The ball nest includes a first portion, where an interior section of the first portion forms at least part of a zone of a sphere. The ball nest also includes a second portion. An interior section of the second portion forms at least part of the zone of the sphere and the second portion is configured to mate with the first portion. The ball nest further includes an adjustable attachment, where the adjustable attachment is configured to adjust the position of the first portion relative to the second portion. The ball nest additionally includes a first friction pad, where the first friction pad is located on the interior section of the first portion, and a second friction pad, where the second friction pad is located on the interior section of the second portion. The ball nest also includes one or more pins, where the one or more pins are configured to mate with the one or more slots in the portable plate. The system also includes a ball, where the mating of the first portion and the second portion is configured to enclose the ball. The ball is configured to rotate within the ball nest. The system further includes a pole, where the pole is attached to the ball, and a ring where the ring is attached to the pole. The system additionally includes a handle. The handle is located at least partially within the interior of the ring and is configured to rotate within the interior of the ring. The system additionally includes a ring attachment, where the ring attachment is configured to attach the ring to the pole.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
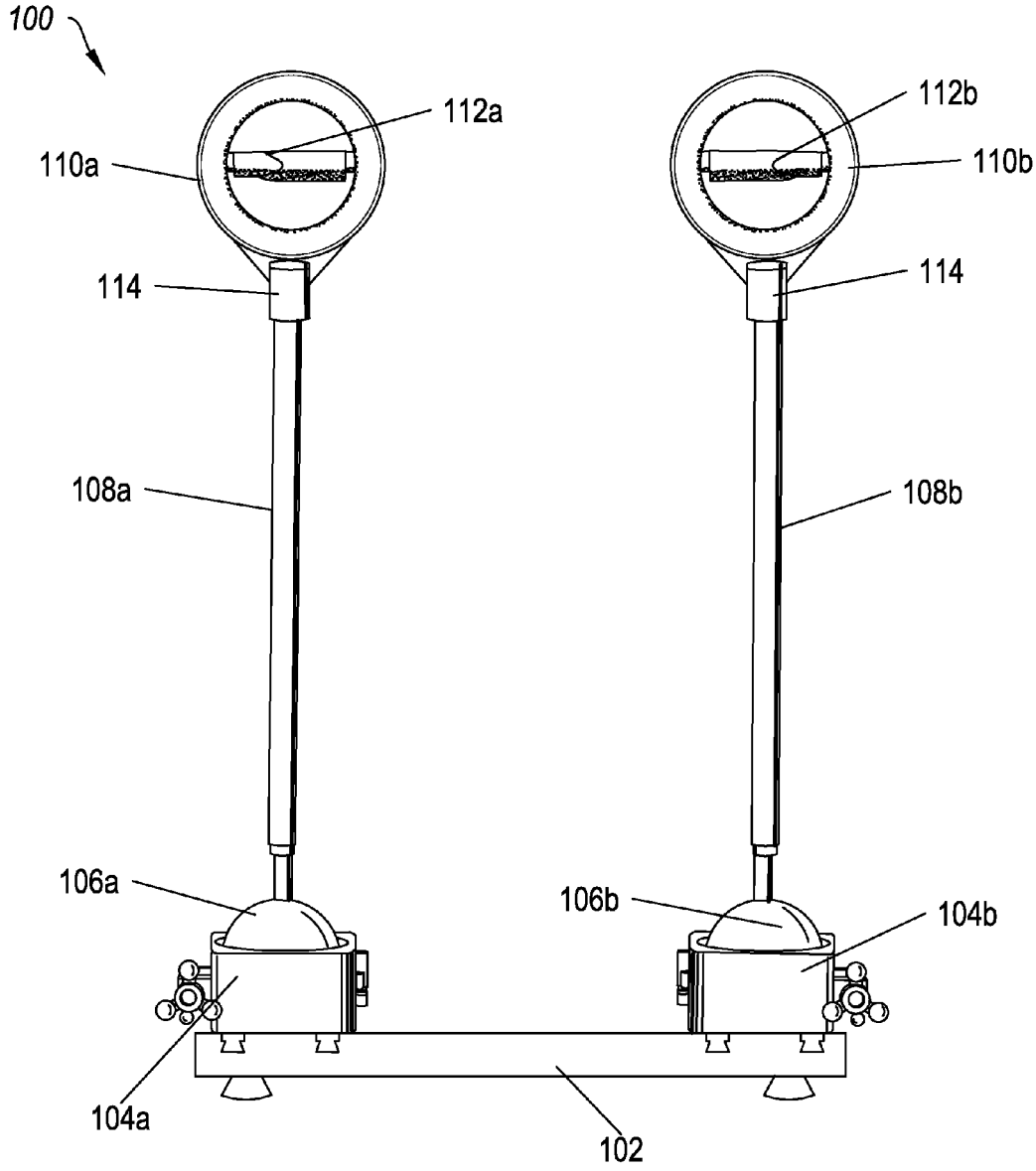
FIG. 1A illustrates front view of the exercise system.
Figure 1B:
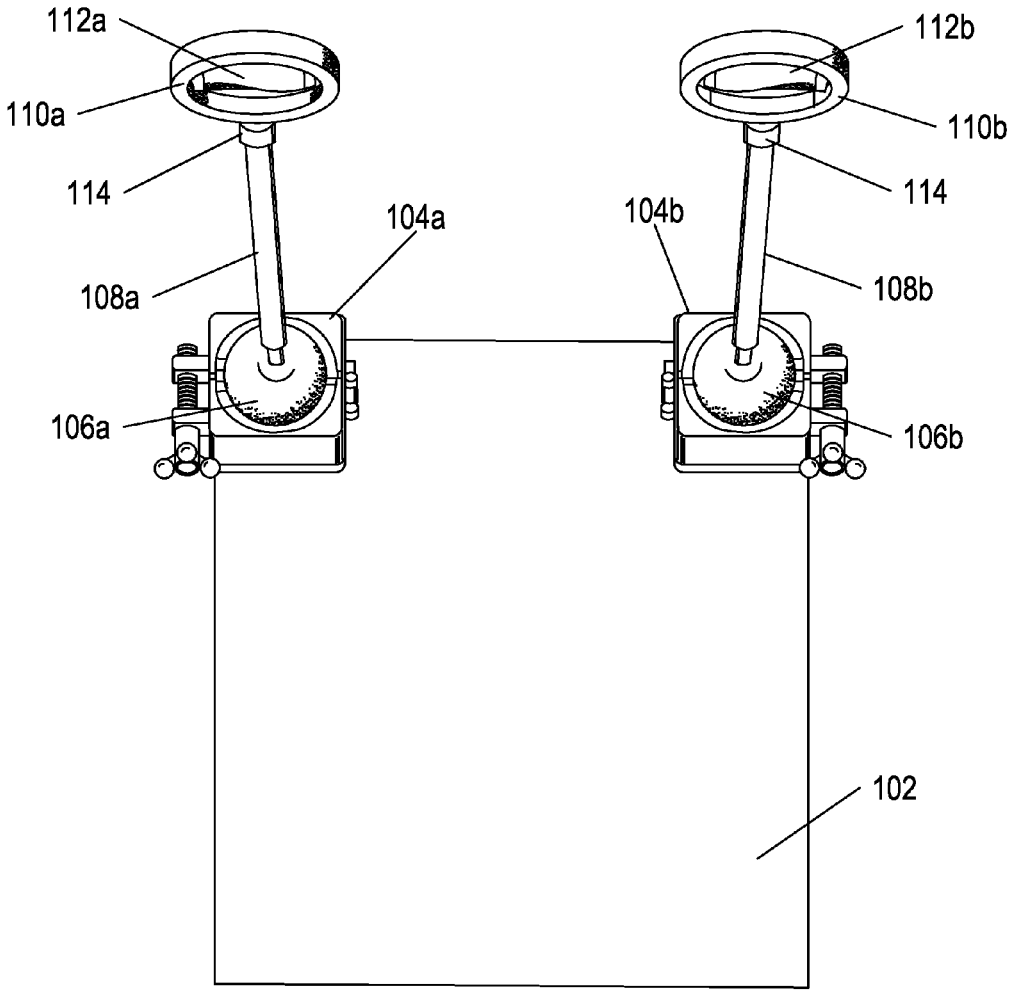
FIG. 1B illustrates a top perspective view of the exercise system.

FIGS. 1A and 1B illustrate an example of an exercise system 100. FIG. 1A illustrates front view of the exercise system 100; and FIG. 1B illustrates a top perspective view of the exercise system 100. In at least one implementation, the exercise system 100 can be used to increase the physical fitness of a user. In particular, the exercise system 100 can allow the user to perform a variety of movements with varying resistance. The resistance can be provided through friction rather than elasticity which reduces or eliminates the reactive force transmitted to the user's body. I.e., the exercise system 100 can increase the user's physical fitness with a reduced chance of injury.

FIGS. 1A and 1B show that the exercise system 100 can include a portable plate 102. In at least one implementation, the portable plate 102 can support the other elements of the exercise system 100. In particular, the portable plate 102 can be easily moved and can provide a stable foundation for the exercises system 100. I.e., the portable plate 102 can be placed or mounted in the desired locations, such as a floor, a wall a ceiling or any other location and the exercises system 100 can be attached to the portable plate 102. The portable plate 102 can be made of metal, metal alloys, plastics, polymers or any other suitable material.

FIGS. 1A and 1B also show that the exercise system 100 can include a first ball nest 104*a* and a second ball nest 104*b* (collectively "ball nest 104" or "ball nests 104"). In at least one implementation, the ball nests 104 can provide resistance to a user's motion during exercise, as described below. In particular, the ball nests 104 can allow the user to adjust the resistance of the exercise system 100. The greater the resistance, the more the force the user has to exert, increasing the intensity of the user's workout. The ball nest 104 can be made of metal, metal alloys, plastics, polymers or any other suitable material.

FIGS. 1A and 1B further show that the exercise system 100 can include a first ball 106*a* and a second ball 106*b* (collectively "ball 106" or "balls 106"). In at least one implementation, the first ball 106*a* and the second ball 106*b* are installed in the first ball nest 104*a* and the second ball nest 104*b* respectively. Together a ball nest 104 and a ball 106 form a ball and socket joint. A ball and socket joint is a joint in which an external device attached to the ball 106 is capable of motion around an indefinite number of axes, which have one common center. I.e., regardless of the direction and distance of motion of the ball 160 and any attached device, the center of the ball 106 remains constant. The ball 106 can be made of metal, metal alloys, plastics, polymers or any other suitable material.

One of skill in the art will appreciate that the interaction between the ball nest 104 and the ball 106 will include resistance due to friction. The amount of friction can be modified in order to adjust the resistance. This can allow the user to vary the amount of resistance during the workout. In particular, the user can increase the resistance for a more difficult workout or decrease the resistance for a less difficult workout.

FIGS. 1A and 1B additionally show that the exercise system 100 can include a first pole 108*a* and a second pole 108*b* (collectively "pole 108" or "poles 108"). In at least one implementation, the pole 108 can be attached to the ball 106. I.e., movement of the pole 108 can be restricted to the range of movement permitted the ball 106 within the ball nest 104. One of skill in the art will appreciate that the resistance applied to the ball 106 by the ball nest 104 is translated to the pole 108. The pole 108 can be made of metal, metal alloys, plastics, polymers or any other suitable material.

In at least one implementation, the pole 108 can telescope. I.e., the pole 108 can include a first portion and a second portion that can fit within the first portion. The position of the first portion can be adjusted relative to the position of the second portion. This can allow the length of the pole 108 to vary in length, as desired by the user. The pole 108 can be biased to a "standard" position. For example, the pole 108 can be spring-loaded to default to its shortest length.

FIGS. 1A and 1B show that the exercise system 100 can include a first ring 110*a* and a second ring 110*b* (collectively "ring 110" or "rings 110"). In at least one implementation, the rings 110 can move relative to one another. As the user moves the rings 110, the movement increases the user's physical fitness. In particular, the resistance to movement of the rings 110 can be increased or decreased as desired by the user. The rings 110 can be made of metal, metal alloys, plastics, polymers or any other suitable material.

FIGS. 1A and 1B also show that the first ring 110*a* and the second ring 110*b* can respectively include a first handle 112*a* and a second handle 112*b* (collectively "handle 112" or "handles 112"). In at least one implementation, the handles 112 can be held by a user during an exercise routine. In particular, the handles 112 can each be held in a user's hand. The exercise system 100 can then be used by the user to perform an exercise routine.

In at least one implementation, the handles 112 can rotate within the plane of the rings 110. For example, handles 112 can rotate relative to the rings 110. Additionally or alternatively, the handles 112 can be attached to a first portion of the rings 110 which can be rotated relative to the other portions of the rings 110. I.e., the rings 110 can include one or more portions, which are able to rotate relative to one another and the handles 112 can be attached to one or the portions of the rings 110, as described below.

FIGS. 1A and 1B further show that the exercise system 100 can include one or more ring attachments 114. In at least one implementation, the one or more ring attachments 114 can allow the pole 108 to be connected to the rings 110. For example, the one or more ring attachments 114 can include a rivet, pin, bolt or the like which allows the ring to move relative to the resistance chamber. I.e., the one or more ring attachments 114 can allow the rings 110 to rotate relative to the attachment point. Additionally or alternatively, the one or more ring attachments 114 can allow the rings 110 to rotate in three dimensions, using a joint such as a ball and socket joint.

In at least one implementation, the exercise system 100 can be configured to electronically communicate with an external device. For example, the exercise system 100 can be connected to a computer, a smart phone, a gaming console or any other electronic device. The electronic device can monitor the user's movements and/or the effectiveness of the user's exercise routine. For example, the electronic device can measure the user's heart rate or provide feedback for the user's exercise routine. E.g., the electronic device can monitor the motion of the various parts of the exercise system 100 and inform the user regarding motion that is overextended or underextended or regarding motion that includes starts and stops or interruptions to the user's exercise routine. Additionally or alternatively, the electronic device can provide information over numerous exercise sessions or routines. For example, the electronic device can show the user's progress as the user increases in strength and health.

The exercise system 100 can connect to the external device using any communications means. For example, the exercise system 100 can be physically connected or can be wirelessly connected to the external device. Additionally or alternatively, the exercise system 100 can connect to the external device using a network. The network exemplarily includes the Internet, including a global internetwork formed by logical and physical connections between multiple wide area networks and/or local area networks and can optionally include the World Wide Web ("Web"), including a system of interlinked hypertext documents accessed via the Internet. Alternately or additionally, the network includes one or more cellular RF networks and/or one or more wired and/or wireless networks such as, but not limited to, 802.xx networks, Bluetooth access points, wireless access points, IP-based networks, or the like. For example, the network can include cloud based networking and computing. The network can also include servers that enable one type of network to interface with another type of network.

Figure 2A:
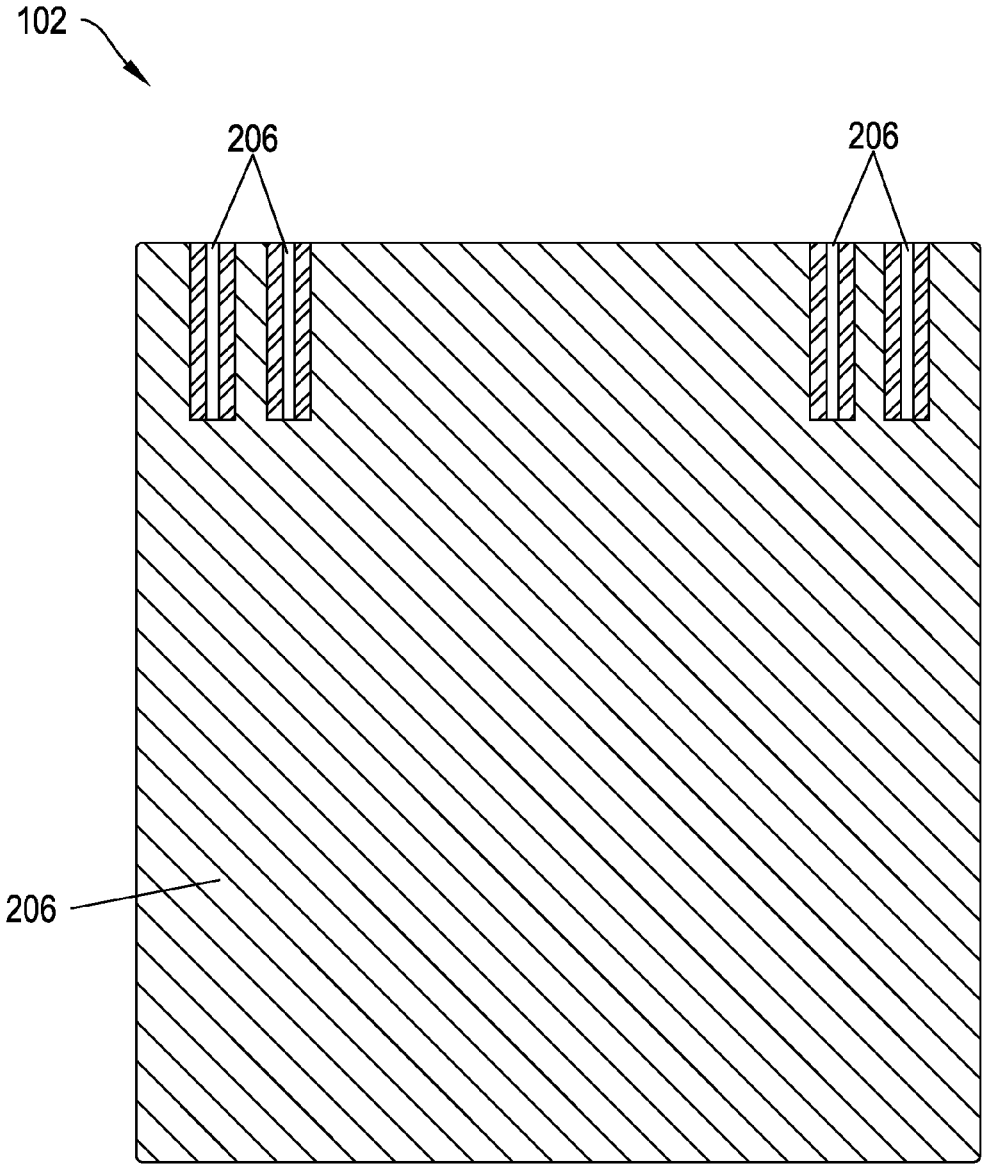
FIG. 2A illustrates a top view of the portable plate.
Figure 2B:
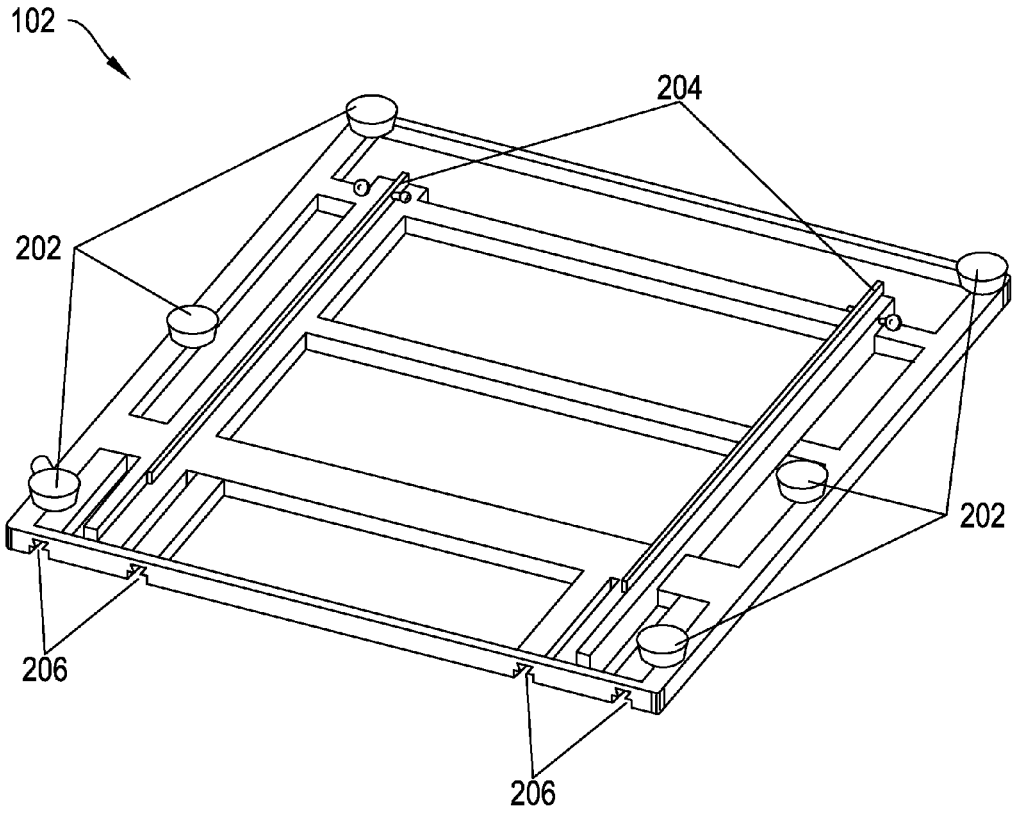
FIG. 2B illustrates a bottom perspective view of the portable plate.

FIGS. 2A and 2B illustrate an example of a portable plate 102. FIG. 2A illustrates a top view of the portable plate 102; and FIG. 2B illustrates a bottom perspective view of the portable plate 102. In at least one implementation, the portable plate 102 can be used to attach an exercise system to an external surface. For example, the portable plate 102 can be rested on a surface, such as a floor. Additionally or alternatively, the portable plate 102 can be mounted on a non-horizontal surface such as a wall or a ceiling.

FIGS. 2A and 2B show that the portable plate 102 can include one or more feet 202. In at least one implementation, the one or more feet 202 can be used to adjust the height of the portable plate 102. I.e., the one or more feet 202 can be attached to the portable plate 102 with a screw or other threaded attachment. To adjust the height of the feet, the user can twist or untwist the threaded connection to adjust the height of the feet 202. The feet 202 can be adjusted individually to allow the portable plate 102 to rest firmly against an uneven surface.

In at least one implementation, the feet 202 can be made of material that allows the feet 202 to remain stable on the attached surface. I.e., the feet 202 can be made of non-slip material. For example, the feet 202 can be made of rubber or other suitable materials. Non-slip material can help ensure that the feet 202, and therefore the portable plate 102, do not move along the external surface.

FIGS. 2A and 2B also show that the portable plate 102 can include a functional attachment 204. In at least one implementation, the functional attachment 204 can allow the portable plate 102 to be attached to a surface or to an external device. For example, the functional attachment 204 can allow the portable plate 102 to be attached to a floor, a wall a ceiling or any other surface as desired by the user. Additionally or alternatively, the portable plate 102 can be attached to a movable platform. An example of a movable platform is disclosed in U.S. application Ser. No. 13/109,658, filed on May 17, 2011, and entitled, "VERTICAL MOVEMENT VIBRATING EXERCISE AND WELLNESS PLATFORM", previously referenced.

FIGS. 2A and 2B further show that the portable plate 102 can include one or more slots 206. In at least one implementation, the one or more slots 206 can allow the user to attach an external device to the portable plate. For example, the one or more slots 206 can allow the user to attach a ball nest, such as the ball nest 104 of FIGS. 1A and 1B. The one or more slots 206 can traverse the entire length of the portable plate 102 or can traverse only part of the length of the portable plate 102. The one or more slots 206 can be located on or near the edge of the portable plate 102 to allow the external device to be inserted.

In at least one implementation, the one or more slots 206 can be used to create a sliding dovetail joint. A sliding dovetail joint can include a trapezoidal slot 206 which interlocks with a matching trapezoidal pin extending from the external device. The trapezoidal shape of the slots 206 and the matching pins can allow the external device to move easily be inserted and retained. In particular, a sliding dovetail joint can allow the external device to easily move laterally within the one or more slots 206 but prevent movement of the external device perpendicularly to the one or more slots 206.

FIGS. 2A and 2B additionally show that the portable plate 102 can include a standing area 208. In at least one implementation, the standing area 208 can allow the user to stand on the portable plate 102 if so desired. In particular, the standing area 208 can include a non-smooth area on the surface of the portable plate 102 which can afford the user a high amount of traction while standing on the portable plate 102.

Figure 3A:
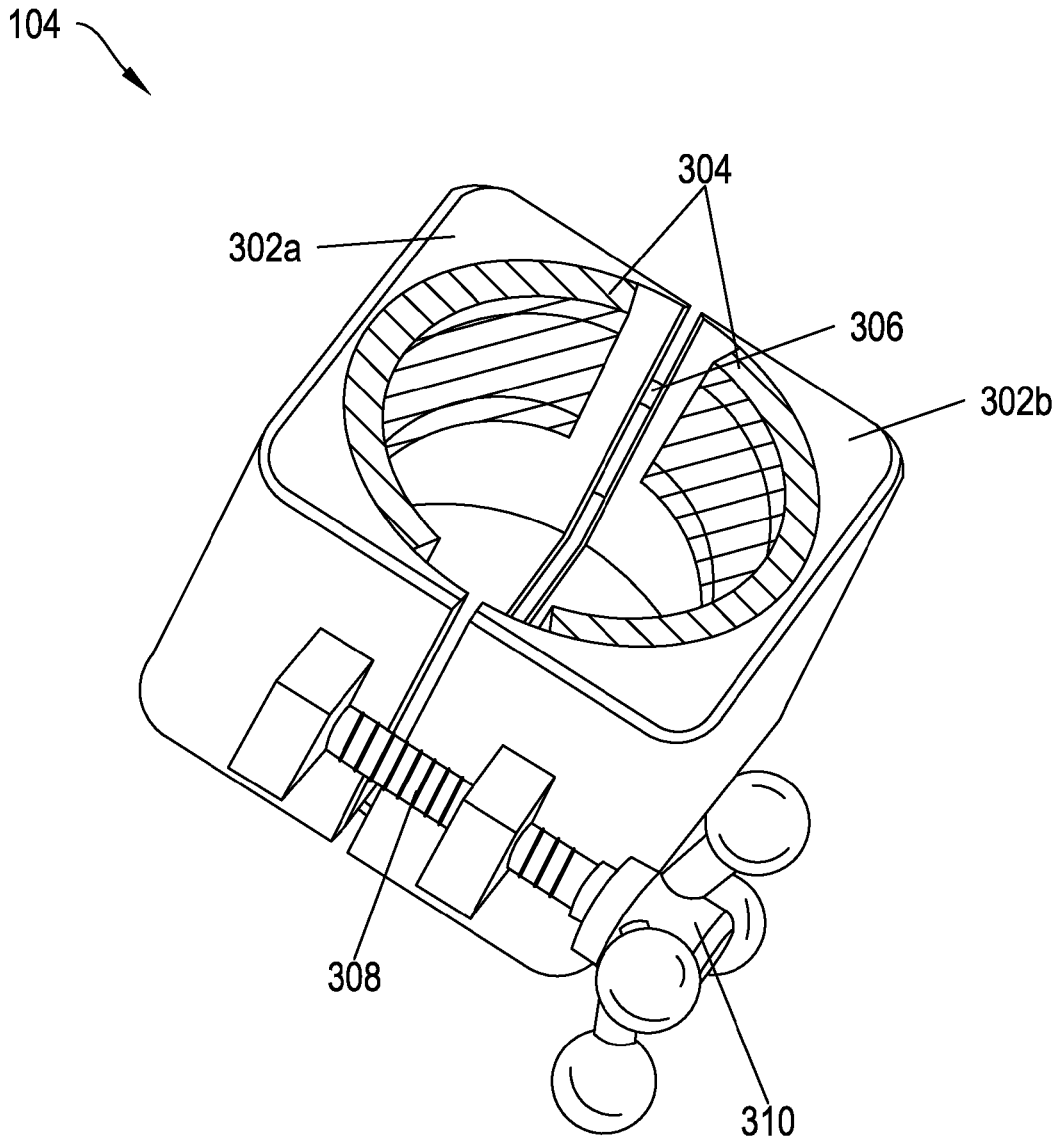
FIG. 3A illustrates a top perspective view of the ball nest.
Figure 3B:
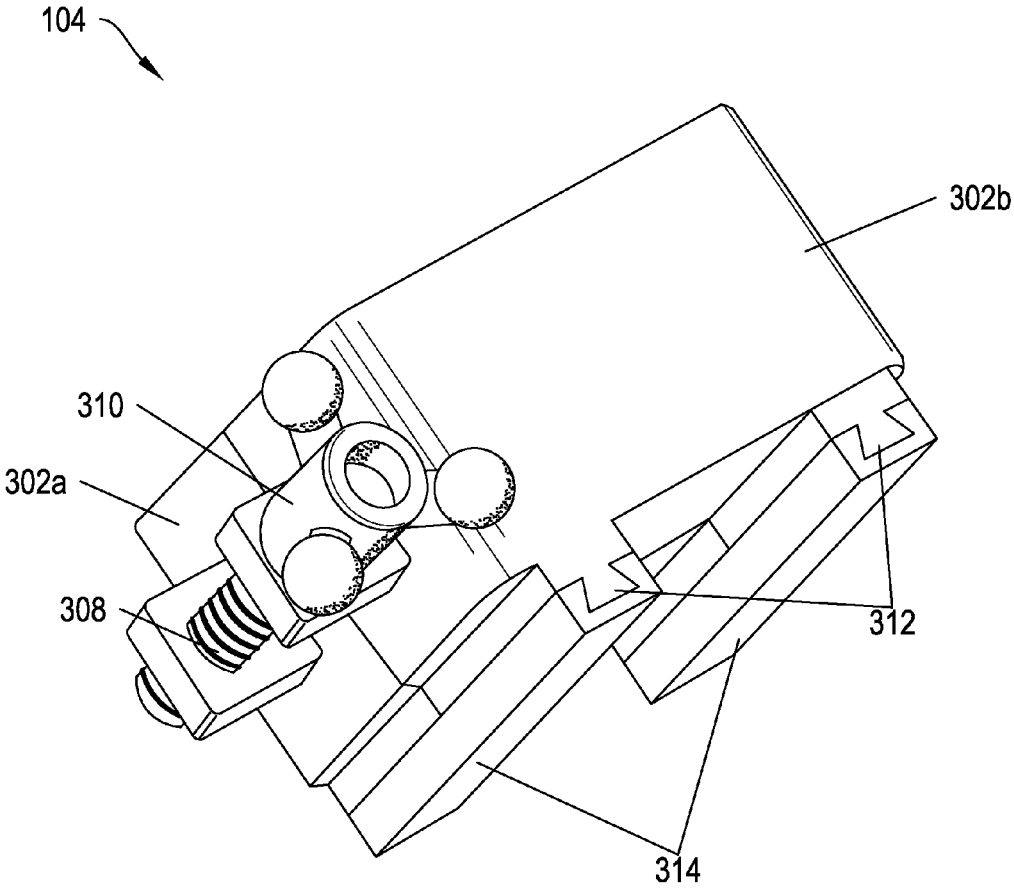
FIG. 3B illustrates a bottom perspective view of the ball nest.

FIGS. 3A and 3B illustrate an example of a ball nest 104. FIG. 3A illustrates a top perspective view of the ball nest 104; and FIG. 3B illustrates a bottom perspective view of the ball nest 104. In at least one implementation, the ball nest 104 can be provide resistance to movement of an enclosed ball, which can provide the desired resistance for a user's exercise routine. The resistance can be created through friction within the ball nest 104. I.e., the ball nest 104 can eliminate reactive force, or forces which enter the user's body from the resistance provided by the ball nest 104.

FIGS. 3A and 3B show that the ball nest 104 can include a first portion 302*a* and a second portion 302*b*. In at least one implementation, the first portion 302*a* and the second portion 302*b* are configured to mate with one another. The first portion 302*a* and the second portion 302*b* each form a portion of a sphere. I.e., as the first portion 302*a* mates with the second portion 302*b* they form at least a portion of a zone. A zone is the curved surface of a spherical segment. A spherical segment is the portion of a sphere cut off by two parallel planes. If the first portion 302*a* and the second portion 302*b* mate to form a zone or portion of a zone that includes a great circle of the sphere, an enclosed ball is allowed to move, but cannot be removed from the ball nest 104. I.e., the mating of the first portion 302*a* and the second portion 302*b* will secure an enclosed ball while allowing the enclosed ball to move along any axis. A great circle of a sphere is the intersection of the sphere and a plane which passes through the center point of the sphere. The first portion 302*a* and the second portion 302*b* can be made of metal, metal alloys, plastics, polymers or any other suitable material.

FIGS. 3A and 3B also show that the ball nest 104 can include a friction pad 304. In at least one implementation, the friction pad 304 can be mounted on the inner surface of the first portion 302*a* and/or the second portion 302*b*. When the first portion 302*a* and the second portion 302*b* are mated to one another the friction pad 304 resists any movement of an enclosed ball. In particular, as the friction pad 304 is pressed against the enclosed ball with more force, it is more difficult for a user to move the enclosed ball. In contrast, as the friction pad 304 is pressed against the enclosed ball with less force, it is less difficult for a user to move the enclosed ball. I.e., the user can change the force being applied to the ball by the friction pad 304 by adjusting the position of the first portion 302*a* and the second portion 302*b* and therefore change the difficulty of moving the enclosed ball, and therefore, the difficulty of the user's exercise routine. The friction pad 304 can be made of cloth, rubber, polymers or any other suitable material.

FIGS. 3A and 3B further show that the ball nest 104 can include a hinge 306. In at least one implementation, the hinge 306 can attach the first portion 302*a* and the second portion 302*b* to one another. In particular, the hinge 306 can allow the first portion 302*a* to move relative to the second portion 302*b*. In particular, the hinge 306 can allow the ball nest 104 to be opened and a ball to be inserted between the first portion 302*a* and the second portion 302*b*.

FIGS. 3A and 3B additionally show that the ball nest 104 can include an adjustment screw 308. In at least one implementation the adjustment screw 308 can allow the user to select a resistance. In particular, the adjustment screw 308 can allow the user to select a precise distance between the first portion 302*a* and the second portion 302*b*. I.e., the user can tighten the adjustment screw 308 lowering the distance between the first portion 302*a* and the second portion 302*b* and increasing the resistance to movement of an enclosed ball. In contrast, the user can loosen the adjustment screw 308 increasing the distance between the first portion 302*a* and the second portion 302*b* and decreasing the resistance to movement of an enclosed ball.

In at least one implementation, the adjustment screw 308 can be permanently attached to the first portion 302*a* and be adjustable with regard to the second portion 302*b* or vice versa. I.e., rotation of the adjustment screw 308 will not produce lateral movement of the adjustment screw 308 relative to the first portion 302*a*. In contrast, rotation of the adjustment screw 308 will produce lateral movement of the adjustment screw 308 relative to the second portion 302*b*. Since the position of the adjustment screw 308 relative to the first portion 302*a* is fixed, rotation of the adjustment screw 308 will produce motion of the second portion 302*b* relative to the first portion 302*a*.

One of skill in the art will appreciate that any mechanism which allows the position of the first portion 302*a* relative to the second portion 302*b* is contemplated herein. For example, the adjustment screw 308 can include a bolt and nut, the tightening of which brings the first portion 302*a* and the second portion 302*b* closer to one another.

FIGS. 3A and 3B also show that the ball nest 104 can include an adjustment knob 310. In at least one implementation, the adjustment knob 310 can turn the adjustment screw 308. In particular, the adjustment knob 310 can be attached to the adjustment screw 308 such that rotation of the adjustment knob 310 causes rotation of the adjustment screw 308.

FIGS. 3A and 3B further show that the ball nest 104 can include one or more pins 312. In at least one implementation, the one or more pins 312 can be used to attach the ball nest 104 to an external device. For example, the one or more pins 312 can be inserted to one or more slots on the external device. For instance, the one or more pins 312 can inserted into the one or more slots 206 of the portable plate 102 of FIG. 1A, FIG. 1B, FIG. 2A and FIG. 2B. The one or more pins 312 can include any desired shape to mate with the slots. For example, the one or more pins 312 can be trapezoidal or round to mate with slots that are trapezoidal or round, respectively.

FIGS. 3A and 3B also show that the ball nest 104 can include one or more pin covers 314. In at least one implementation, the one or more pin covers 314 can slide over the one or more pins 312. In particular, the one or more pin covers 314 can include a flat edge. As the pin covers 314 are placed on the pins 312, the flat edge can be placed against an external surface allowing the ball nest 104 to sit flush against the external surface.

In at least one implementation, the ball nest 104 can include one or more fasteners. In at least one implementation, the one or more fasteners can be used to prevent lateral motion of the ball nest 104. In particular, the one or more fasteners can prevent the one or more pins 312 from moving within one or more slots, fixing the position of the one or more pins 312 within the slots.

Figure 4B:
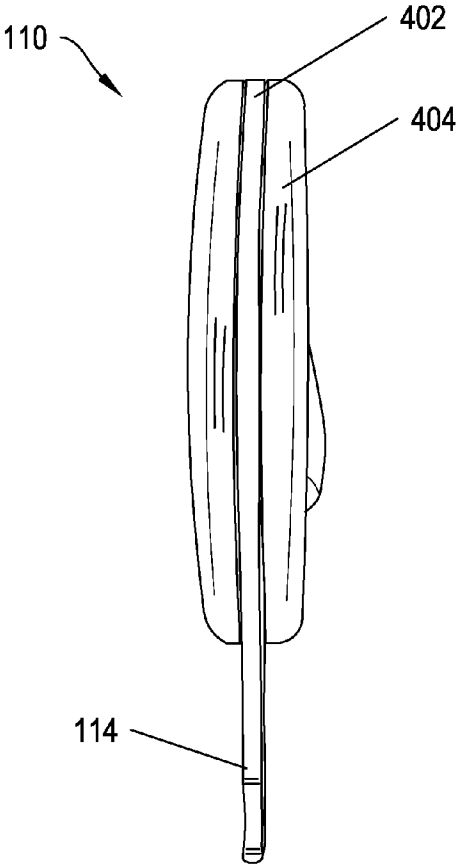
FIG. 4B illustrates a side view of the ring.
Figure 4A:
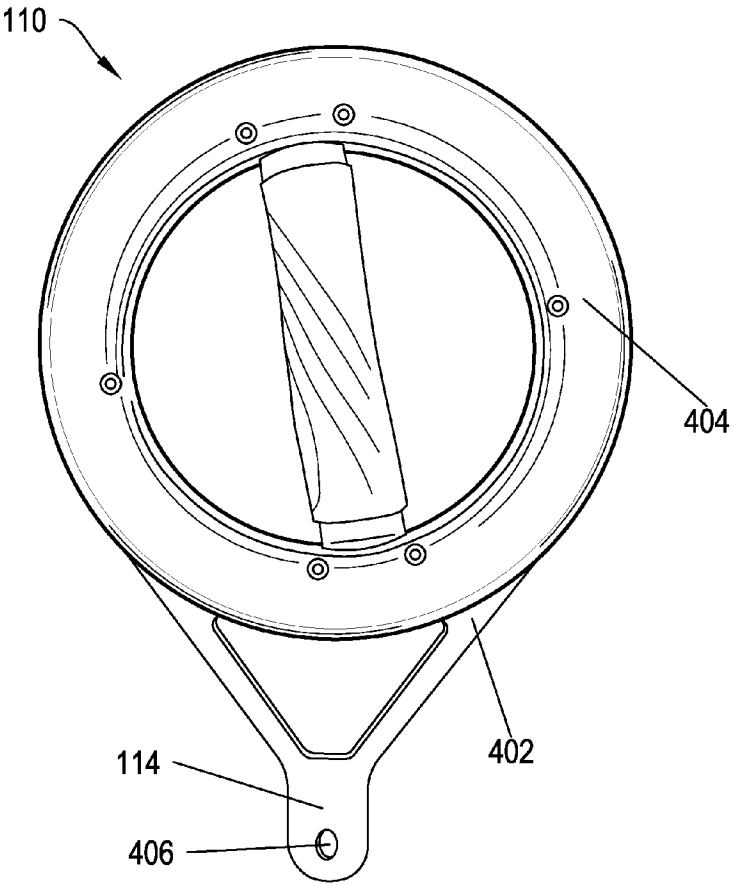
FIG. 4A illustrates a front view of a ring.

FIGS. 4A and 4B illustrate an example a ring 110. FIG. 4A illustrates a front view of the ring 110; and FIG. 4B illustrates a side view of the ring 110. In at least one implementation, the ring 110 can be used as part of an exercise system. One of skill in the art will appreciate that the ring 110 can be used with the exercise system 100 of FIGS. 1A and 1B; however, the ring 110 can be used with an exercise system other than the exercise system 100 of FIGS. 1A and 1B.

FIGS. 4A and 4B show that the ring 110 can include a first portion 402. In at least one implementation, the first portion 402 can be attached to the ring attachment 114. In particular, the first portion 402 can be attached to the ring attachment 114 such that the first portion 402 is not able to move relative to the ring attachment 114.

FIGS. 4A and 4B also show that ring 110 can include a second portion 404. In at least one implementation, the second portion 404 can rotate relative to the first portion 402. In particular, the second portion 404 can be attached to the first portion 402, such that the center point of the first portion 402 and the center point of the second portion 404 coincide with one another. For example the second portion 404 can sandwich, or surround, the first portion 402. As the second portion 404 rotates around the center point, it rotates relative to the first portion 402.

FIGS. 4A and 4B further show that the ring attachment 114 can include an attachment point 406. In at least one implementation, the attachment point 406 can allow the ring 110 to be attached to an external device. For example, the ring 110 can be attached to a pole, such as the pole 108 of FIGS. 1A and 1B. The attachment point 406 can allow the ring to rotate or otherwise move with respect to the external device.

Figure 5:
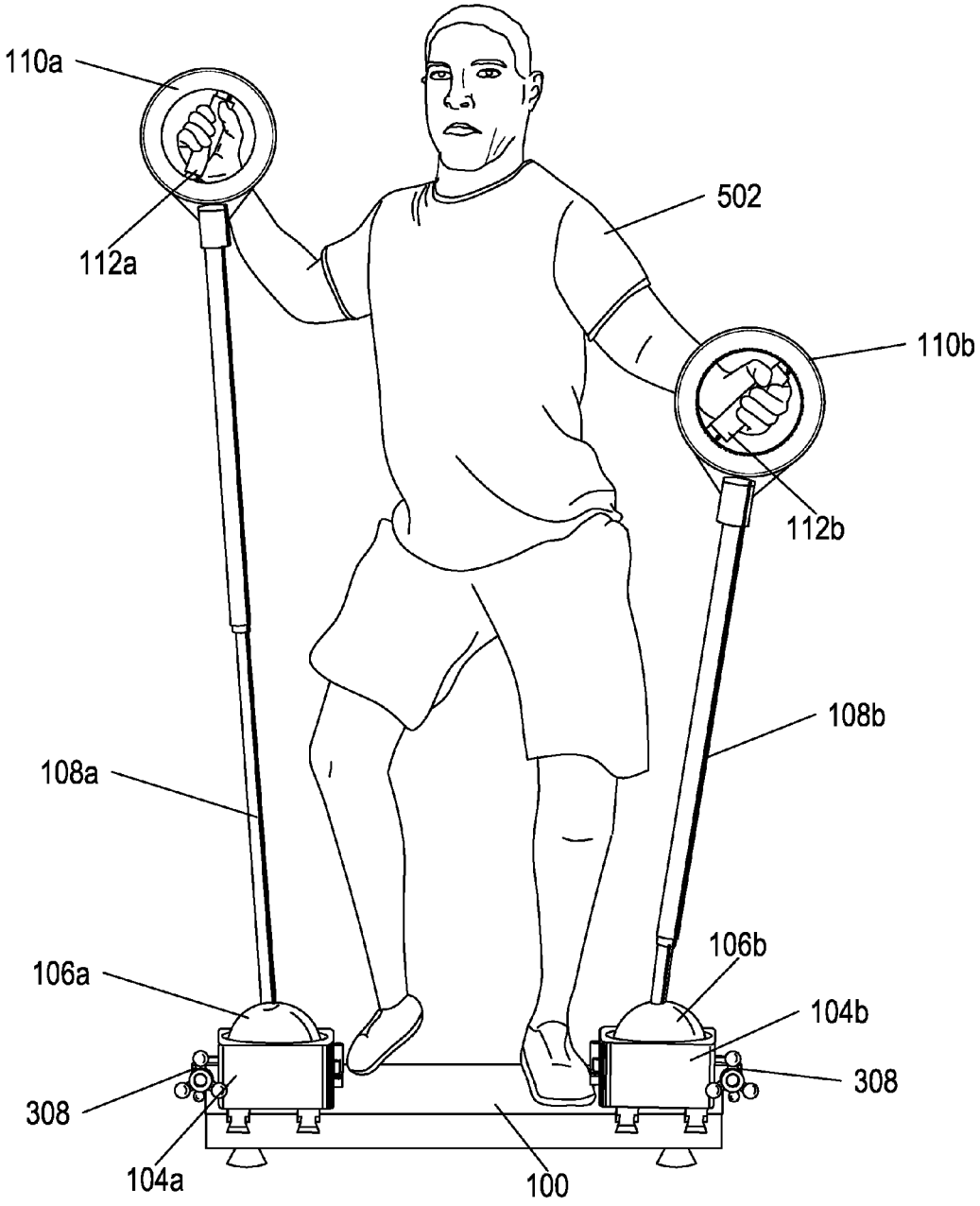
FIG. 5 illustrates an example of a user using the exercise system.

FIG. 5 illustrates an example of a user 502 using the exercise system 100. In at least one implementation, the user 502 can use the exercise system 100 to tone or strengthen his/her muscles. In particular, the exercise system 100 recreates natural movements of the human body, allowing the user 502 to exercise with little or no detrimental impact to the body of the user 502. I.e., the exercise system allows the user 502 to exercise using natural movements and low impact resistance.

FIG. 5 shows that the user 502 can hold the exercise system 100 using the handles 112. In at least one implementation, the user 502 can place one hand on the first handle 112*a* and the other hand on the second handle 112*b*. As the user 502 moves the rings 110, the resistance provided by the ball nests 104 to rotation of the balls 106 can provide resistance to the movement of the rings 110.

FIG. 5 also shows that the user 502 can rotate the first ring 102*a* and the second ring 102*b*. As the user 502 moves the first ring 102*a* and the second ring 102*b* the movement is transmitted by the poles 108*a* and 108*b* respectively to the first ball 106*a* and the second ball 106*a* respectively. The first ball nest 104*a* and the second ball nest 104*a* provides resistance to the movement of the first ball 106*a* and the second ball 106*b* which resists the movement of the rings 110. The more resistance, the harder the user 502 must work to complete the movement. The user 502 can adjust the resistance using the adjustment screw 308, as described above.

In at least one implementation, the user 502 can use a supplemental exercise device, such as a vertical movement vibrating exercise and wellness platform. An example of a vertical movement vibrating exercise and wellness platform is disclosed in U.S. application Ser. No. 13/109,658, filed on May 17, 2011, and entitled, "VERTICAL MOVEMENT VIBRATING EXERCISE AND WELLNESS PLATFORM", previously referenced. In particular, the user 502 can balance himself/herself on the platform while using the exercise system 100. However, the platform is moving up and down. Therefore, the user 502 must balance himself/herself while directing the movement of the rings 110, making the exercise routine more difficult and, consequently, more beneficial to the user.

Additionally or alternatively, the user 502 can use other supplemental exercise devices, such as weights or other exercise systems, while using the exercise system 100.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A ball nest for providing resistance in an exercise system, the ball nest comprising:

a first portion, wherein an interior section of the first portion forms at least part of a zone of a sphere;

a second portion, wherein:

an interior section of the second portion forms at least part of the zone of the sphere; and the second portion is configured to mate with the first portion;

wherein the mating of the first portion and the second portion is configured to enclose a ball;

an adjustable attachment, wherein the adjustable attachment is configured to adjust the position of the first portion relative to the second portion; and one or more pins, wherein the one or more pins are configured to mate with one or more slots in an external device.

2. The ball nest of claim 1, further comprising:

a first friction pad, wherein the first friction pad is located on the interior section of the first portion.

3. The ball nest of claim 2, further comprising:

a second friction pad, wherein the second friction pad is located on the interior section of the second portion.

4. The ball nest of claim 3, wherein:

the first friction pad includes a polymer; and the second friction pad includes the polymer.

5. The ball nest of claim 1, wherein the adjustable attachment includes a screw.

6. The ball nest of claim 5 further comprising:

a handle attached to the screw, wherein the handle is configured to allow the user to adjust the position of the screw.

7. The ball nest of claim 5 wherein the screw is:

secured in the first portion; and threaded in the second portion;

wherein rotation of the screw produces lateral motion of the second portion relative to the first portion.

8. The ball nest of claim 1, wherein the one or more pins include one or more trapezoidal pins.

9. The ball nest of claim 8, wherein the external device includes a portable plate.

10. The ball nest of claim 9, wherein the portable plate includes:

one or more slots, wherein the one or more slots are configured to receive the one or more trapezoidal pins.

11. A system for allowing a user to exercise, the system comprising:

a ball nest, wherein the ball nest includes:

a first portion, wherein an interior section of the first portion forms at least part of a zone of a sphere;

a second portion, wherein:

an interior section of the second portion forms at least part of the zone of the sphere; and the second portion is configured to mate with the first portion;

an adjustable attachment, wherein the adjustable attachment is configured to adjust the position of the first portion relative to the second portion; and one or more pins, wherein the one or more pins are configured to mate with one or more slots in an external device;

a ball, wherein the mating of the first portion and the second portion is configured to enclose the ball;

wherein the ball is configured to rotate within the ball nest.

12. The system of claim 11 further comprising an external device attached to the ball.

13. The system of claim 12, wherein the external device includes a pole.

14. The system of claim 13, wherein the external device includes a ring attached to the pole.

15. The system of claim 13, wherein the pole includes a telescoping pole.

16. A system for allowing a user to exercise, the system comprising:

a portable plate, wherein the portable plate includes:

one or more feet, wherein the one or more feet are configured to support the portable plate against an external surface; and one or more slots;

a ball nest, wherein the ball nest includes:

a first portion, wherein an interior section of the first portion forms at least part of a zone of a sphere;

a second portion, wherein:

an interior section of the second portion forms at least part of the zone of the sphere; and the second portion is configured to mate with the first portion;

an adjustable attachment, wherein the adjustable attachment is configured to adjust the position of the first portion relative to the second portion;

a first friction pad, wherein the first friction pad is located on the interior section of the first portion; and a second friction pad, wherein the second friction pad is located on the interior section of the second portion; and one or more pins, wherein the one or more pins are configured to mate with the one or more slots in the portable plate;

a ball, wherein the mating of the first portion and the second portion is configured to enclose the ball;

wherein the ball is configured to rotate within the ball nest;

a pole, wherein the pole is attached to the ball;

a ring, wherein the ring is attached to the pole;

a handle, wherein the handle:

is located at least partially within the interior of the ring; and is configured to rotate within the interior of the ring; and a ring attachment, wherein the ring attachment is configured to attach the ring to the pole.

17. The system of claim 16, wherein the pole is configured to change length when a lateral force is applied by the user.

18. The system of claim 16, wherein the portable plate further includes:

one or more attachments, wherein the one or more attachments are configured to allow the portable plate to attach to the external surface.

19. The system of claim 16, wherein the one or more slots of the portable plate are trapezoidal in shape.

* * * * *